US006278044B1

(12) United States Patent
Ruan

(10) Patent No.: US 6,278,044 B1
(45) Date of Patent: Aug. 21, 2001

(54) VIOLIN SHOULDER CRADLE

(76) Inventor: Ying Gang Ruan, 12014 W. 130th St., Overland Park, KS (US) 66213

( * ) Notice: Subject to any disclaimer, the term of this patent is extended or adjusted under 35 U.S.C. 154(b) by 0 days.

(21) Appl. No.: 09/614,279

(22) Filed: Jul. 12, 2000

(51) Int. Cl.[7] ..... G10D 1/02

(52) U.S. Cl. ..... 84/279; 84/280; 84/281; 84/29

(58) Field of Search ..... 84/279, 280, 281, 84/290

(56) References Cited

U.S. PATENT DOCUMENTS

| | | | | |
|---|---|---|---|---|
| 156,613 | * | 11/1874 | White | 84/279 |
| 217,330 | * | 7/1879 | Bull | 84/279 |
| 550,386 | * | 11/1895 | Davis | 84/279 |
| 576,950 | * | 2/1897 | Coloney | 84/279 |
| 5,415,070 | * | 5/1995 | Kaman | 84/279 |
| 6,031,163 | * | 2/2000 | Cullum et al. | 84/279 |

OTHER PUBLICATIONS

Shar Holiday Gift Guide, (serving string musicians since 1962), "Now through Jan. 8, 2000," 4 selected pages, including cover, back cover, p. 23, and unnumbered page, Shar Products Company, Ann Arbor, Michigan.

* cited by examiner

*Primary Examiner*—Robert E. Nappi
*Assistant Examiner*—Kim Lockett
(74) *Attorney, Agent, or Firm*—Hovey, Williams, Timmons & Collins

(57) ABSTRACT

A violin shoulder cradle is provided for supporting a violin or similar stringed instrument on the shoulder of a musician. The cradle broadly includes a base for coupling adjacent the back of the violin body and a shoulder rest. The shoulder rest is contoured to substantially conform to the musician's shoulder while maintaining the desired substantially horizontal orientation of the violin along its longitudinal axis while in use. The outer surface of the shoulder rest is generally sloped from the remote edge toward the proximate edge inwardly toward the base, and includes a waist section which is closest the base, rising toward the first end in a plurality of steps.

20 Claims, 2 Drawing Sheets

VIOLIN SHOULDER CRADLE

BACKGROUND OF THE INVENTION

1. Field of the Invention

This invention broadly concerns a shoulder cradle useful for violins, violas and similar stringed instruments intended for support on the shoulder of the musician. More particularly, it is concerned with a shoulder cradle which is provided with a stepped shoulder-engaging shelf and which maintains the instrument at the proper position.

2. Description of the Prior Art

Violins produce tones when a bow is drawn across the strings, known as arco, or when the strings are finger-plucked (pizzacato). As used herein, the term "violin" is intended to include similar instruments such as violins of reduced size, such as half or three-quarter sized violins, and violas, where the instrument is typically positioned between the shoulder and chin of the musician. The violin produces a sympathetic vibration between the instrument's belly and back, which adds volume and resonance to the sound produced by the vibration of the strings. A chin rest is typically provided adjacent the tail piece between the belly of the violin body which provides a support between the musician's chin and the violin body.

Shoulder rests have sometimes been used between the violin body and the musician's shoulder. In the simplest form, the cushion includes a small fabric or elastic cushion which if held between the back of the violin body and the shoulder of the wearer. These shoulder rests help to support and cushion the violin against the shoulder of the wearer whereby the hard wooden back of the violin is separated from the musician's shoulder. However, they have lacked features which would inhibit the violin from slippage on the shoulder and which promote proper playing positions.

SUMMARY OF THE INVENTION

These and other objects are largely met by the violin shoulder cradle of the present invention. That is to say, the violin shoulder cradle hereof not only inhibits slippage and promotes the maintenance of the violin in the proper playing position, but is ergonomically configured for comfort and precise conformation to the shoulder of the musician.

Broadly speaking, the violin shoulder cradle hereof includes a base having instrument gripping legs and a shoulder rest which is stepped into a plurality of different shelves in order to better conform to the wearer's shoulder. The shoulder rest includes a relatively hard foundation which provides the stepped shelves, on which is preferably applied a relatively thin cushion. Most preferably, the cushion has a surface of a friction-promoting material such as velvet cloth or the like which resists slippage relative to the clothing of the wearer. The stepped shelves engage the bone structure of the musician's shoulder and clavicle, thereby providing levels of engagement in contrast to a surface without such stepped shelves which is prone to slippage.

Additionally, the arms of the base extend laterally to firmly grasp the instrument, thereby providing a solid and unitary platform to rest on the musician's shoulder. At least one of the legs is preferably adjustably coupled to the base to permit the musician to adjust the distance between the instrument and the shoulder rest to accommodate the physical size and playing position of the musician. The cradle will enable the musician to be more relax ed during performing, thereby accommodating a good technique and allowing the musician to comfortably play longer and better.

These and other advantages will be readily apparent to those skilled in the art with reference to the drawings and description which follow.

DESCRIPTION OF THE PREFERRED EMBODIMENT

Figure 1:
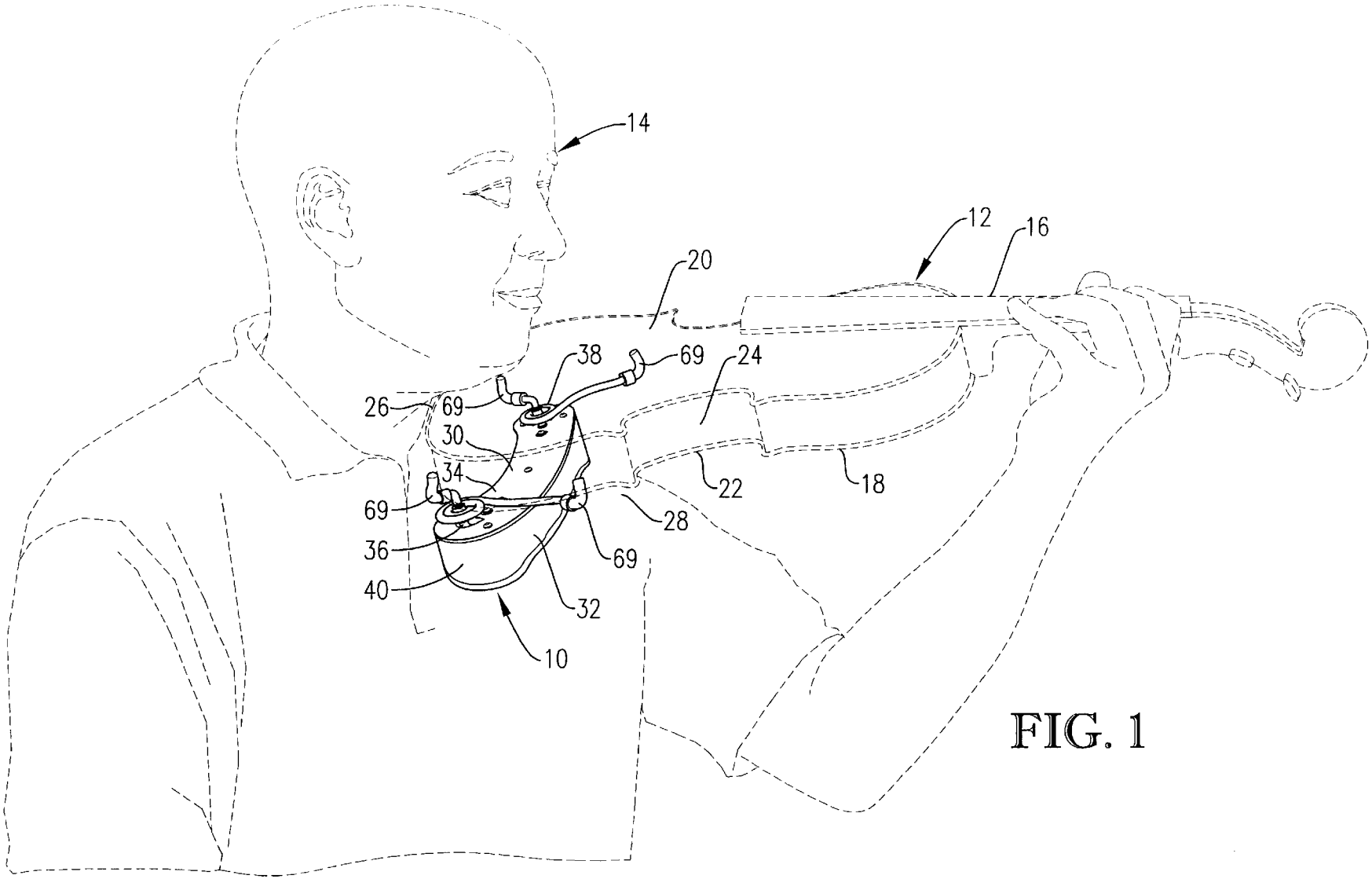
FIG. 1 is a perspective view of the violin shoulder cradle of the present invention with the musician and the violin shown in dashed lines for ease of viewing the cradle.

Referring now to the drawings, FIG. 1 shows a violin shoulder cradle 10 in accordance with the present invention mounted on a violin 12 properly positioned for playing by a musician 14. For reference purposes, the violin 12 includes a neck 16 corresponding to a central longitudinal axis and normally positioned away from the neck of the musician, and a body 18. The body 18 has a belly 20 with a chin rest on which the chin of the musician is placed and a back 22 opposite the belly 20 and spaced therefrom by a surrounding rib 24. It is to be understood that the violin 12 has strings extending along the longitudinal axis of the violin 12 from the remote end of the neck 16 to a tail piece adjacent its bottom end 26, which vibrate when plucked or when a bow is drawn across the strings.

Figure 2:
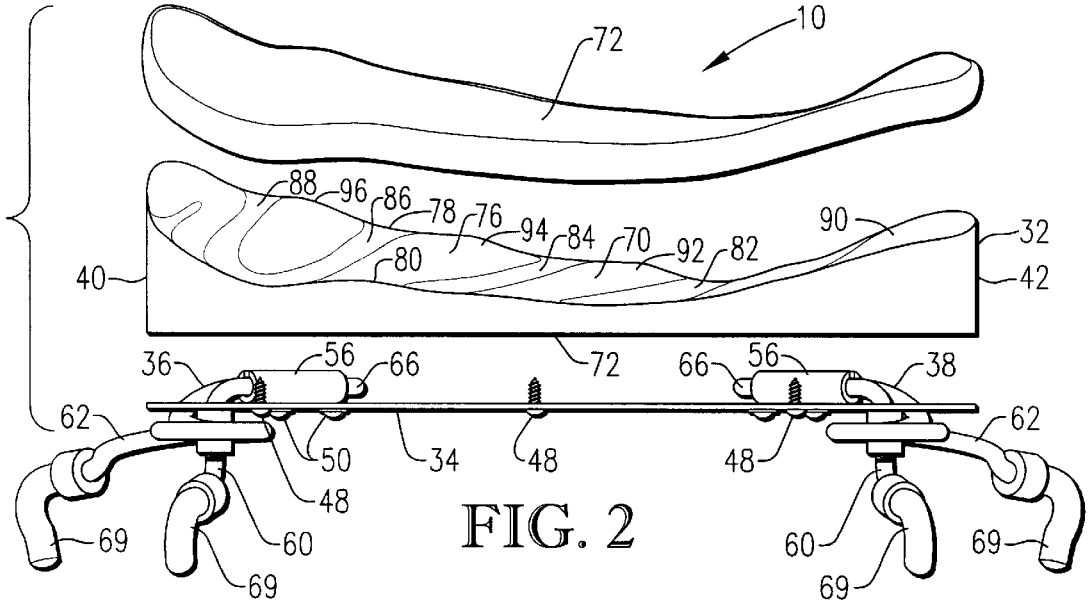
FIG. 2 is a an exploded and inverted side elevational view of the cradle hereof viewed from the tail end of the violin located nearest the musician's neck when in use, showing the pad, shoulder rest and base.
Figure 3:
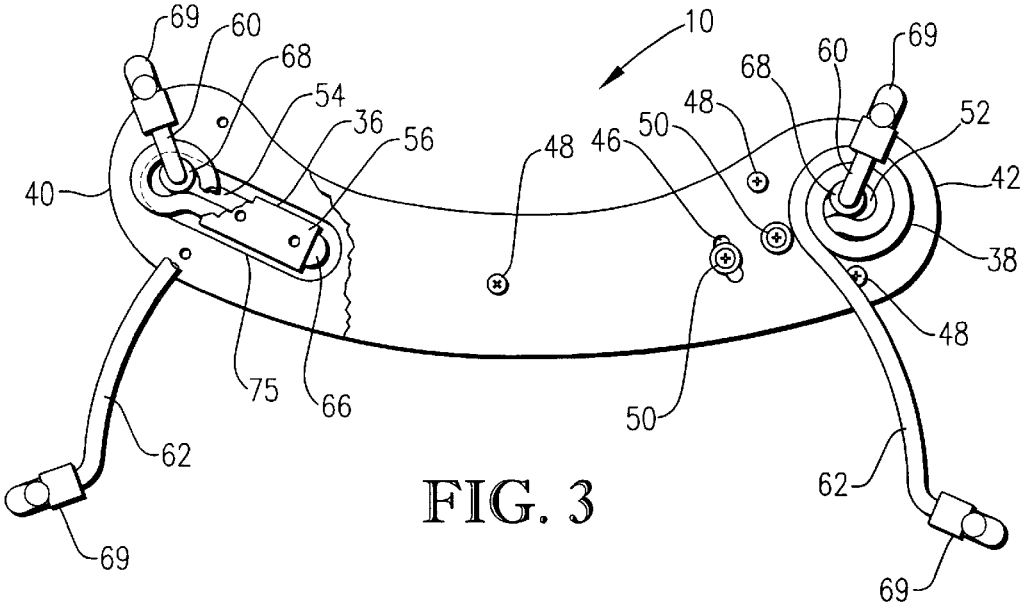
FIG. 3 is a bottom view of the cradle hereof, with a portion of the base plate an d a portion of one leg broken away for clarity.

The cradle 10 hereof is placed between the back 22 of the violin 12 and the shoulder 28 of the musician when the violin is played, as shown in FIG. 1. The cradle 10 broadly includes a base 30 and a shoulder rest 32. The base 30 includes a base plate 34 and first and second couplers 36 and 38. The base plate 34 is preferably generally arcuate as shown in FIGS. 2 and 3 and substantially conforms to the shoulder rest 32 along the inner surface thereof, the shoulder rest 32 having a first end 40 and a second end 42 which are enlarged in width relative to midsection 44. The base plate 34 includes a plurality of apertures 46 for receiving screws 48 for attachment of the base 30 to the shoulder rest 32, and also for receiving screws 50 for mounting the couplers 36 and 38 to the base plate 34. In addition, the base plate 34 includes enlarged openings 52 proximate the first end 40 and the second end 42 for permitting a portion of the couplers 36 and 38 to pass therethrough.

Figure 4:
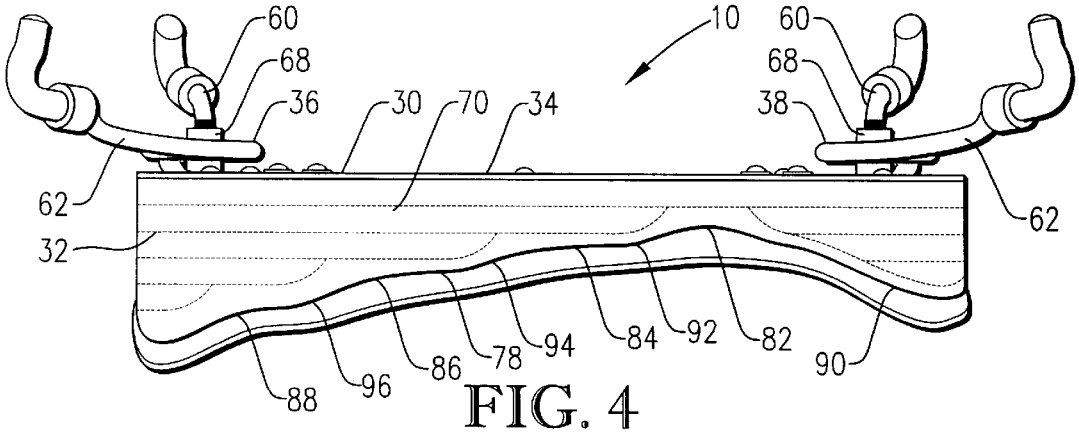
FIG. 4 is a side elevational view of the cradle hereof taken from the side of the cradle normally oriented away from the musician's neck to show the stepped shelves to be supported on the musician's shoulder.

The couplers 36 and 38 each have an elongated wire loop 54 and a clamp 56. The clamp 56 is coupled on the back surface 58 of the base plate 34 by screws 50. The wire loops 54 each have first leg 60 and second leg 62, as well as spiral section 64 and clamped bend 66 received in clamp 56. The spiral section 64 is substantially flat, as shown in FIGS. 2 and 4. The first leg 60 is preferably vertically adjustable and has a threaded end received in one end of an internally threaded sleeve 68, while the portion of the clamped bend 66 opposite the spiral section 64 is threaded and threadably received into the opposite end of the sleeve 68. Thus, the first leg 60 is not only vertically adjustable but also free to swing. Both the first leg 60 and the second leg 62 have terminal ends over which a rubber foot 69 is placed for clamping against the rib 24 of the violin 12, as illustrated in FIG. 1.

The shoulder rest 32 generally includes a foundation 70 and a covering pad 72. The foundation 70 is made of a relatively dense and firm material such as wood, e.g. walnut, or a synthetic resin such as an acyrlic or polymethyl methacrylate, and may be molded or formed to shape, or conformed by machining a series of laminated sheets as illustrated by the dotted lines in FIG. 4. The foundation 70 has relatively flat inner surface 74 facing the base plate 34 with the exception of recesses 75 for receiving the clamped bends 66 and clamp 56, and a contoured outer surface 76. The outer surface 76 is sloped so that the thickness between the outer surface 76 and the inner surface 74 along the remote edge 78 normally oriented toward the violin's neck is greater than the thickness between the inner surface and the outer surface along the proximate edge 80. The difference in thickness at the remote edge 78 versus the proximate edge 80 produces a varied and conforming slope along the outer surface 76 which is generally greater toward the first end 40 than the second end 42, but in so sloping compensates for the slope of the musician's shoulder, such that base plate 34 and the back 22 of the violin are substantially horizontal when supported and held between the chin and shoulder of the musician 14, even when the neck of the violin is unsupported by the musician's hand.

It may also be seen from FIGS. 1, 2 and 4 that the outer surface 76 of the foundation 70 is also provided with a waist 82 between the first and second ends. The waist 82 is more proximate the base 30 and thus in the area of the waist 82, the foundation 70 is of reduced thickness. A plurality of stepped shelves 84, 86, and 88 of gradually increasing thickness when viewed in elevation extending from the waist 82 toward the first end 40, and a generally continuous rise 90 extends from the waist 82 toward the second end 42. The shelves 84, 86 and 88 are thus intended to be positioned on the forward part of the musician's shoulder, the waist 82 on the top of the musician's shoulder, and the rise 90 extending from the top of the musician's shoulder partway down the back of the shoulder 28. The shelves 84, 86 and 88 are not flat and slope from the remote edge 78 toward the proximate edge 80 as described above, with shelf 84 separated from waist 82 by ridge 92, and shelves 84, 86 and 88 separated by respective ridges 94, 96 and 98. The ridges are angled at about 5 to 20 degrees and more preferably about 7 to 10 degrees from the adjacent shelf, and adjacent shelves are preferably of thicknesses varying between about ⅛ inch to about ⅝ inch and more preferably about ¼ inch to ½ inch therebetween, such that shelf 84 would be about ⅛ inch to about ⅝ inch below the adjacent shelf 86 as viewed in FIG. 2. The size and spacing of the shelves and ridges may be varied according to the size of the overall cradle 10, such that the dimensions and spacing of a cradle designed for a child using a small violin would be less than for a full sized adult, who would in turn typically play a full sized violin or viola, but the ridges provide a separation between the adjacent shelves to step the shelves as opposed to a continuous slope. The pad 72 is configured to overlie the foundation 70 but to be relatively thin and only moderately compressible of a material such as high density closed cell foam so as to ensure that the definition of the stepped shelves and waist 82 are not lost or substantially diminished by the pad 72. The pad 72 preferably includes a non-slip covering material, such as velvet or the like, which resists slippage on the musician's clothing.

In use, the first leg 60 of each of the couplers is turned to a desired height for the user so as to provide the desired and comfortable placement of the violin 12 according to the musician's style and physical build. The cradle 10 is then coupled to the violin 12 as shown in FIG. 1, with the remote edge 78 oriented toward the neck 16 and the base plate 34 toward the back 22 of the violin 12, with the first and second ends 40 and 42 oriented generally transverse to the longitudinal axis of the violin which extends along the length of the neck 16. The violin 12 slightly spreads the legs 60 and 62 of each coupler away from each other. This in turn spreads the spiral section 64 which acts as a spiral spring to clamp the violin 12 between the legs 60 and 62. The musician need only then place the violin 12 on his or her shoulder with the outer surface 76 generally conforming to the shoulder muscle, clavicle and acromion.

What is claimed is:

1. A violin shoulder cradle for supporting a violin on the shoulder of a musician, the violin having a neck and a longitudinal axis, said cradle comprising:

a base adapted for coupling to a violin;

a shoulder rest coupled to the base and extending generally transverse to the longitudinal axis of the violin between a first end and a second end, said shoulder rest including a foundation having an inner surface oriented toward the base and an outer surface oriented away from the base and defining a thickness between the inner surface and the outer surface, the thickness of the foundation being greater at one of the first end or the second end than at a location therebetween.

2. A violin shoulder cradle as set forth in claim 1, wherein said foundation includes a waist intermediate said first and second ends and wherein said foundation is of substantially incompressible material, said foundation being of relatively greater thickness between the outer surface and the inner surface at each of the first and second ends than at a waist located threbetween.

3. A violin shoulder cradle as set forth in claim 1, wherein said shoulder rest includes a waist intermediate the first end and the second end and a plurality of stepped shelves intermediate the waist and the first end, said shoulder rest further including a ridge of greater slope than the adjacent shelves positioned between the waist and the first end.

4. A violin shoulder cradle as set forth in claim 3, wherein said foundation is of substantially incompressible material, said foundation being of relatively greater thickness at a shelf more proximate the first end than at said waist.

5. A violin shoulder cradle as set forth in claim 4, wherein said inner surface of said foundation is relatively flat and said outer surface is contoured.

6. A violin shoulder cradle as set forth in claim 5, including a pad overlying said outer surface.

7. A violin shoulder cradle as set forth in claim 1, wherein said foundation includes a remote edge and an opposite proximate edge, the proximate edge being generally more distant from the base than the remote edge.

8. A violin shoulder cradle as set forth in claim 7, wherein said foundation is of substantially incompressible material, said foundation being of relatively greater thickness at the remote edge than at a corresponding opposed portion of the foundation along the proximate edge.

9. A violin shoulder cradle as set forth in claim 8, wherein said inner surface of said foundation is relatively flat and said outer surface is contoured.

10. A violin shoulder cradle as set forth in claim 9, including a pad overlying said outer surface.

11. A violin shoulder cradle as set forth in claim 1, wherein said base includes first and second couplers for cooperative attachment to the violin, each of said couplers including first and second generally divergent legs.

12. A violin shoulder cradle as set forth in claim 11, wherein each of said couplers includes a coil section resiliently biasing ones of said first and second legs of one of said couplers toward a leg of the other of said couplers when a violin is inserted therebetween.

13. A violin shoulder cradle as set forth in claim 11, wherein at least one of the first and seconds legs of at least one of said couplers is adjustably mounted for movement toward and away from said shoulder rest.

14. A violin shoulder cradle as set forth in claim 13, wherein each of said coupler includes a sleeve for threadably receiving one of said legs therein.

15. A violin shoulder cradle for supporting a violin on the shoulder of a musician, the violin having a neck and a longitudinal axis, said cradle comprising:

a base adapted for coupling to the violin; and a shoulder rest coupled to said base and extending generally transverse to the longitudinal axis between a first end and a second end, said shoulder rest including an inner surface oriented toward the base and an outer surface oriented away from the base, said outer surface including a remote edge oriented generally toward the neck of the violin when mounted thereon and an opposite proximate edge, the proximate edge being generally more distant from the base than the remote edge.

16. The violin shoulder cradle of claim 15 said shoulder rest including a foundation having a greater thickness at said first end and at said second end than at a waist located therebetween.

17. The violin shoulder cradle of claim 16, said foundation presenting a greater thickness at said first end than at said second end.

18. The violin shoulder cradle of claim 15, said shoulder rest including a foundation, said foundation having a greater thickness at said proximate edge than along a corresponding opposed portion of said remote edge.

19. A violin shoulder cradle for supporting a violin on the shoulder of a musician, the violin having a longitudinal axis, said cradle comprising:

a base adapted for coupling to the violin; and a shoulder rest coupled to the base and extending generally transverse to the longitudinal axis of the violin between a first end and a second end, said shoulder rest including a foundation of substantially incompressible material having an inner surface oriented toward the base and an outer surface opposed thereto, the foundation having a waist intermediate the first and second ends, said foundation being of relatively greater thickness between the outer surface and the inner surface at each of the first and second ends than the waist.

20. A violin shoulder cradle for supporting a violin on the shoulder of a musician, the violin having a longitudinal axis, said cradle comprising:

a base adapted for coupling to the violin, said base including first and second couplers adapted for cooperative attachment to the violin, each of said couplers including first and second generally divergent legs; and a shoulder rest coupled to the base and extending generally transverse to the longitudinal axis of the violin between a first end and a second end, said shoulder rest including a foundation having an inner surface oriented toward the base and an outer surface.

* * * * *